United States Patent [19]

Puro

[11] 4,414,868

[45] Nov. 15, 1983

[54] BOX JOINT FOR A PLIER-TYPE TOOL WITH REMOVABLE SECURING PLATE

[75] Inventor: Nicholas S. Puro, Upper Saddle River, N.J.

[73] Assignee: Micro Dent Industries, Inc., Hawthorne, N.J.

[21] Appl. No.: 337,663

[22] Filed: Jan. 7, 1982

[51] Int. Cl.[3] ..... B25B 7/06

[52] U.S. Cl. ..... 81/416; 30/193

[58] Field of Search ..... 81/416; 30/186, 191, 30/193; 403/157, 161

[56] References Cited

U.S. PATENT DOCUMENTS

| | | | |
|---|---|---|---|
| 810,402 | 1/1906 | Friese | 30/186 |
| 1,676,574 | 7/1928 | Ostermeier | 30/186 |
| 2,305,156 | 12/1942 | Grubel | 81/416 |
| 3,602,074 | 8/1971 | Smith | 81/416 |
| 3,952,749 | 4/1976 | Fridolph et al. | 81/416 |

*Primary Examiner*—James L. Jones, Jr.
*Attorney, Agent, or Firm*—Ralph R. Roberts

[57] ABSTRACT

This invention pertains to a box joint for use with plier-type tools and the like. These tools are pivotally retained with two members having handles and jaws. The box joint provided has a first member with a midportion of conventional construction and with an aperture through which the shank of a shoulder screw is passed. A second member has its outer wall portions formed with one wall integral with and extending from the handle to the jaw portion and the other outer wall having a transverse opening therethrough with each end of this opening made as a shouldered or stepped end. The opening and the stepped end configuration has the narrower opening at the inner portion and through this narrower opening the midportion of the first member passes when and while normal to its closed or in-use condition. The inturned shoulders adjacent the stepped opening of the second member are adapted to engage and retain the midportion of the first member when the first and second members are moved to the closed and operating condition. A retaining plate is sized to be snugly seated in the stepped opening and has a through aperture in which the shank of the retaining cap screw is passed. A threaded end of the cap screw is mounted in a threaded aperture in the integral outer wall of the second member. The jaws of the first and second members can and are hardened or provided with inserts and all surfaces of the box joint plate and jaws are precisely finished without distortion as would occur from the conventional use of heat or applied pressure.

11 Claims, 5 Drawing Figures

BOX JOINT FOR A PLIER-TYPE TOOL WITH REMOVABLE SECURING PLATE

BACKGROUND OF THE INVENTION

1. Field of the Invention

With reference to the field of art as established by and in the U.S. Patent Office this invention is believed to be found in the General Class entitled, "TOOLS" (Class 81) and more particularly in the subclass entitled, "crossed handles" (Subclass 415) and the subclass thereunder entitled, "joint detail" (subclass 416).

2. Description of the Prior Art

A careful pre-Ex search of the prior art was made and although box joint tools are well known, the use of a securing plate to hold the joint together that did not further require that the joint have a retaining shoulder or surface support for the two moving portions as is provided in a conventional box joint was not found. The construction of a conventional box joint requires that the box opening in one member be opened and distorted usually by heat and the other member be passed through said box opening. The joint is then brought to its finished condition usually by applying heat and pressure. This second heating affects the temper or hardness in the jaw ends.

The resulting box joint, although stronger than a lap joint, requires a difficult finishing of the contiguous members in the joint but the play in the joint is compensated for by a rivet or screw. The resulting joint tends to develop play at its inception or shortly after being put into use. Although careful and expensive fitting of the joint is made the resulting tool, after use, does not have the initial or the permanent accuracy desired in precision tools. In the tool to be hereinafter shown and described a precise ground joint with all surfaces precisely formed and sized is provided. A small degree of tightening adjustment is also available.

Box joints as used with pliers and tongs are shown in U.S. Pat. No. 259,886 to MATTHEY as issued June 20, 1882 and U.S. Pat. No. 2,948,962 to MANNING as issued Aug. 16, 1960. Also of note is U.S. Pat. No. 788,575 to BERNARD as issued May 2, 1905 and U.S. Pat. No. 914,417 to CRUZE as issued Apr. 6, 1909. Combination joints with a modified box with the cover plate riveted or screwed in place are shown. These joints, with additional plate securing means, do not contemplate the making of a box joint assembly with the members retained in position by formed and integral portions and with the securing plate preventing unwanted disassembly.

SUMMARY OF THE INVENTION

This invention may be summarized, at least in part, with reference to its objects. It is an object of this invention to provide, and it does provide, a box joint for pliers and like tools in which the box joint members ar made with that member having the two outer connecting portions having a determined spaced formed in one connecting portion and into and through which the other member with its finished midportion is adapted to enter the box joint when and while the members are turned at substantially right angles to each other.

It is a further object of this invention to provide, and it does provide, a box joint in which one of the outer walls of the box joint member is removed to provide a grooved opening transverse of the axis of the tool, this grooved opening wider in width than the mating midportion of the other member when this member is turned substantially at right angles. The groove has shouldered ends with the outer portion of the groove greater than the inner width and into this opening is mounted a securing plate tightened into place by threaded means.

It is a further object of this invention to provide, and it does provide, a grooved opening in which in one embodiment the ends are formed with an angle on an outward facing surface and the mating covering plate is made with a compatible shape so that when tightened into retaining condition the angled surface retains the open side in a secured condition. In another embodiment the outer facing surface of the stepped edges of the opening are made substantially parallel to the seating surface for the contiguously mounted midportion of the member.

In brief, this invention pertains to box joint tools and particularly plier-type devices in which the jaw ends are precisely formed and hardened. These pliers are particularly useful in the dental profession and for small electronic assembly. The present invention in the first member provides the handle and jaw of selected configuration with the midportion finished with a superior surface and a precisely formed and sized through aperture. This portion of the tool may be finished by grinding and the jaw finished and hardened or with inserted material. Jigs, fixtures and inspection techniques not available in conventional box joints are utilized.

The other and second mating member provides the outer portions of the box joint but instead of two outer integral portions one of the outer portions is formed with a transverse opening. This opening is made with stepped end facing portions. The narrower portion of the opening is at the inner portion of the joint and is disposed to accept and retain the midportion of the mating member. The width of the slot opening is slightly greater than the width of the midportion of the mating member when turned substantially normal to the theoretical axis of the tool. The members providing the box joint and the jaw are finished and hardened or constructed with inserted materials. Jigs, fixtures and inspection techniques may also be utilized.

The covering plate that closes and retains the grooved opening has its ends formed to mate with and be inserted into the grooved opening. The cover plate has a through aperture for inserting therethrough a headed cap screw. This cap screw is retained in a threaded aperture formed and provided in the connecting outer portion of the box joint member. The covering plate may have angled edge portions or may have edge portions that have surfaces substantially parallel to the interior supporting surface.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been chosen a specific embodiment of a box joint for a plier-type tool with removable securing plate as adopted for use in pivoted tools and showing a preferred means for forming the ends of the opening and constructing a mating cover plate. This specific embodiment and an alternate configuration have been chosen for the purposes of illustration and description as shown in the accompanying drawing wherein:

BRIEF DESCRIPTION OF THE DRAWING

In the following description and in the claims various details are identified by specific names for convenience. These names are intended to be generic in this application. Corresponding reference characters refer to like members throughout the several figures of the drawings.

DESCRIPTION OF THE EMBODIMENT OF FIGS. 1 THROUGH 4

Figure 1:
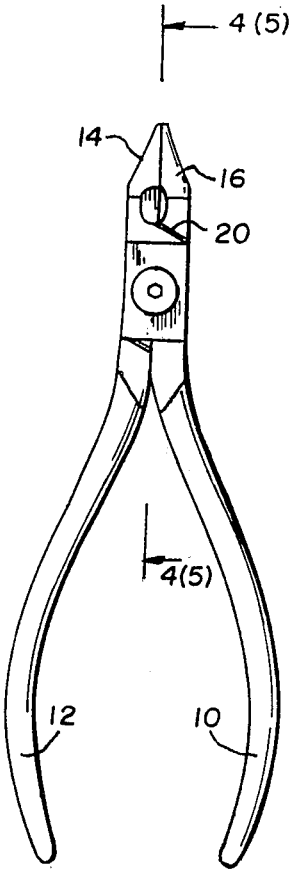
FIG. 1 represents a front or face view of a pair of pliers constructed with the improved box joint construction of this invention.
Figure 2:
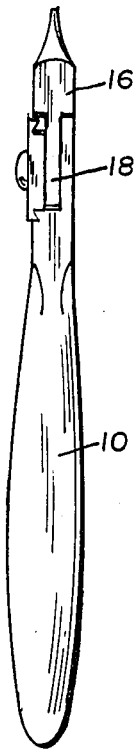
FIG. 2 represents a side view of the plier of FIG. 1 and and showing the removable plate used with the improved box joint.
Figure 3:
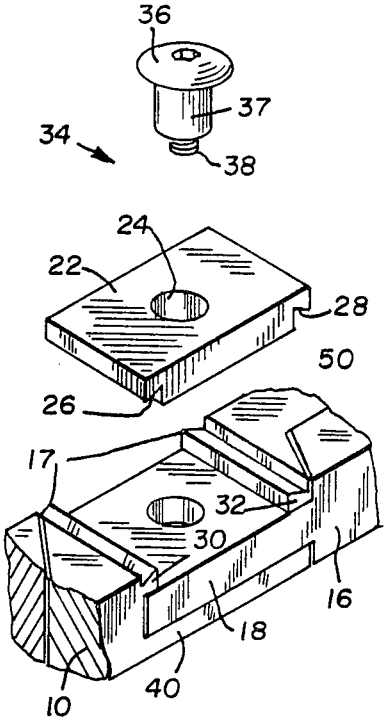
FIG. 3 represents an exploded isometric view in an enlarged scale and showing the box joint construction of FIG. 1 but turned one hundred eighty degrees for clarification of construction.

Referring next and now to the drawing, FIGS. 1 through 4 show the plier and box joint with said box joint having an access opening in one side so that the joint members may be precisely finished. There are two movable handle portions 10 and 12 which are integral with jaw portions 14 and 16. As identified, handle 10 is integral with the rightward extending jaw 14 and the handle 12 is integral with the rightward extending jaw 16. As viewed in FIG. 1 the portion between handle 10 and jaw 14 is removed and is identified as 17 so that the interior surfaces may be precisely finished. The central portion extending between handle 12 and jaw 16 is identified as midportion 18 and is integral with and extends between said handle and jaw.

As seen in FIG. 1 there is a slanted separation identified as 20 which enables jaw 14 and jaw 16 to be constructed when and where said jaws are contoured for shear cutting or otherwise shaped. The box joint provided by the handle portion 10 and the jaw 14 is closed by a plate member 22 which includes a through hole or aperture 24 and in the showing of FIGS. 2, 3 and 4 has angled shaped ends 26 and 28. These angled shaped ends engage and are seated in compatibly angled shaped grooves 30 and 32 in the member containing handle 10 and jaw 14. A cap screw 34 has a head 36 and a reduced shank portion 37 with a further reduced diameter portion on which are formed threads 38. This cap screw in its shank portion 37 is slightly less than the thickness of the midportion 18 plus plate member 22. This permits the plate member 22 to be brought tightly into sliding retention when the cap screw 34 is mounted and tightened. The lower internal portion of the plier pair that extends between handle 10 and jaw 14 is identified as 40 and has a threaded aperture 41 for threads 38 on the cap screw. The midportion 18 has its ends contoured or rounded as required to allow swinging of the jaws to their desired condition.

USE AND OPERATION OF THE EMBODIMENT OF FIGS. 1 THROUGH 4

Figure 4:
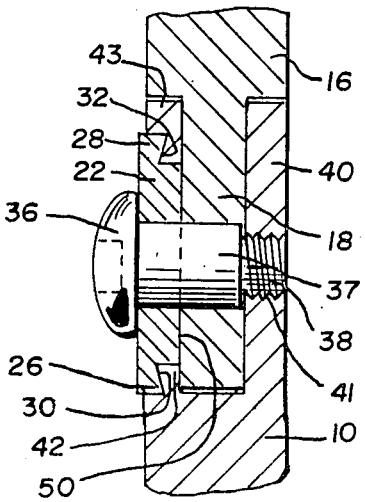
FIG. 4 represents a sectional side view of only the box joint construction, this view partly fragmentary with the handle and jaw portions not shown, this view in an enlarged scale and taken on the line 4—4 of FIG. 1 and looking in the direction of the arrows.

It is to be noted that the width of the connecting midportion 18 of the tool member is less than the width of the transverse opening 17 formed in and through the outer wall of the box joint portion of the other tool member. In this manner the assembled tool is rotated and maintained in normal operation whereas the disassembled tool may be taken apart for inspection and then reassembled when the midportion 18 is passed through the transverse opening 17. The handles are brought toward each other with the midportion 18 sliding rotatably beneath the upper extents 42 and 43 of the handle 10 and jaw 14. This extension of the upper portion of the box joint of the member having the transverse opening 17 as seen in FIG. 4 wherein the assembled box joint is shown with the plate 22 brought into a retaining condition. The angled edges of the plate 22 has the undercut made as with an angled cutter. The plate 22 is precisely faced at 50 and the plate 22 and the angled ends 26 and 28 are matched with shaped grooves 30 and 32 at the edges of the opening between handle 10 and jaw 14. Precise sizing is easily achieved with grinding and the surface finished achieved may approach or equal an eight mu finish. The tightening of the screw 34 brings the joint into the desired snugness. The shank 37 of the screw is made shorter than the thickness of the midportion 18 and plate 22 providing the box joint.

ALTERNATE EMBODIMENT OF FIG. 5

Figure 5:
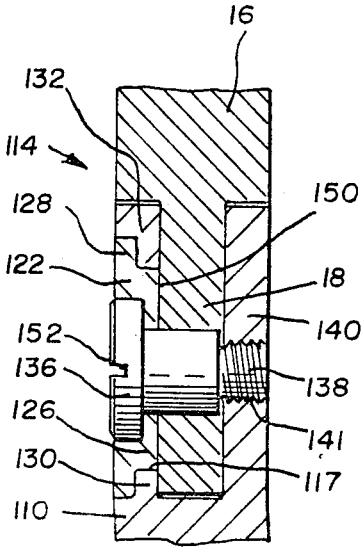
FIG. 5 represents a sectional side view as in FIG. 4 and showing a retaining plate less the dovetail construction of FIG. 4 and with the tightening screw as a slotted flat headed screw, this view like that of FIG. 4 taken on the line 5—5 of FIG. 1 and looking in the direction of the arrows.

Referring next and finally to FIG. 5, there is depicted a box joint that is a slight variation of the assembly of FIG. 4. For convenience in identification, the numbers used in the identification of the components in FIG. 5 are the same as in FIGS. 1 through 4 with said numbers increased by one hundred. In this alternate embodiment a flat headed screw 134 is shown securing a plate 122 which is much like plate 22 above described. This plate is seated in the opening between handle 110 and jaw 114 and instead of angled ends as in FIG. 4 the plate 122 is formed with stepped ends in which the seating surfaces are parallel to the contiguous surface carrying the midportion 18. The plate 122 has its lower face surface 150 precisely formed and surfaced so as to rest on the midportion 18. This portion of the plate 122, as in plate 22 shown in FIG. 4, is narrower than the upper extending portions. Steps 126 and 128 are made with a compatible depth and width so as to snugly seat in the transverse opening in the box joint member.

The upper outer extent of the handle 110 and jaw 114 next to the opening is formed with shoulder or steps 130 and 132. These steps are above and restrain the upper surface of the midportion 18. Threads 138 are formed on flat head screw 134 with the shank 137 being slightly shorter than the thickness of the midportion 18 and the remainder of the plate under the counterbore formed in the plate 122. The head 136 of cap screw 134 is shown with a screw driver slot 152 which is used for tightening and adjusting. As above, the transverse opening 117 is greater than the width of the midportion 18 when the two members are substantially normal to each other. In their assembled and ready-to-use condition the box joint appears as in FIG. 5.

USE AND OPERATION OF THE EMBODIMENT OF FIG. 5

As above, it is to be noted that the opening 117 is greater than the width of the midportion 18 of the mating member forming the box joint. This construction of the disassembled tool permits the members to be turned approximately ninety degrees so the connecting midportion 18 may be brought through the opening 117 after which the members are turned to the condition of FIG. 1. In the mounting of these box members the midportion 18 enters and is seated in that space below the inwardly extending shoulders 130 and 132. When and after these members are brought together and are in a seated condition the plate 122 is brought into mounting and retaining condition.

The flat headed cap screw 134 is passed through the aperture 124 in plate 122 and then through the aperture in the midportion 18. The shank is advanced by turning the threaded portion 138 into the female threaded aperture 141. These compatibly formed threads are shown in the lower integral portion 140. In a tightened condition the flat headed cap screw 134 has its shank portion of a length so that when the head 136 is seated in the counterbore in the upper portion of the plate 122 the tightened screw has the end of the shank 137 a short distance above integral portion 140. This cap screw can and is tightened to bring the assembled box joint to the desired degree of snugness.

In the two embodiments particularly seen in FIGS. 4 and 5 it is noted that the box joint is constructed so that the midportion 18 is slidable in the space provided in the mating member. The extending shoulders are integral with the handle and jaw so that with the mounted plate the box joint is closed. The angled grooves and formed ends as shown in FIG. 4 utilize the angled shoulders to assist in retaining the jaw and handle in close alignment and preventing springing or distortation of the member and its formed slot. In the embodiment of FIG. 5 the flat surface on the shoulders anticipate that excess pressure is not applied to the tool. In the usual construction the flat ends and shoulders on the plate 122 may be used and from a cost standpoint are an advantage.

In either embodiment it is anticipated that a superior finish (2–8 mu) be available through the use of jigs, fixtures and/or grinding. The distorting effect of heating and expanding a closed box for insertion of the companion member and then the use of heat and pounding to close the box is not required or desired with the box joint of this invention. Whether inserts or very hard jaws are provided the box joint of this invention may be precisely made. Wear is kept at a very minimum because of the precision and high finish to all surfaces. Two or three thousandths of an inch may be allowed for adjustment and/or wear. The resulting tool is very superior in application and is more economical to produce.

In the above embodiments and others that may be made it is noted that the plate is contoured so that the upper extending portions are substantially alike and when tightened engage the inwardly extending portions of the box joint member at and in the formed slot. The plate engages and restrains that box joint area adjacent the slot from being displaced upwardly and outwardly. Although angled and flat shoulder portions are shown this does not preclude the forming of the upper surfaces of the ends of the slot and the extending portions of the plate with other configurations such as V-shapes and half moons or other retention shapes. A small clearance in the fit of the plate into the shouldered ends includes breaking the sharp corners and providing small radii.

The retaining plate 122 is shown with a counterbore in which the head 136 of a cap screw is mounted. A similar counter bore may be provided in plate 22 and the socket headed cap screw 34 shown in FIGS. 1, 3 and 4 may be a screw driver slot as in FIG. 5. The cap screw and the mounting of the screw in a plate is merely a matter of preference. It is also to be noted that the inturned retaining portions of the box joint member adjacent the transverse slot is shown as about one-half the thickness of the midportion 18. This inward extent and thickness of the inward securing portions is a matter of preference but the box joint, when the jaws are brought to a closed condition and are manipulated for normal use, is retained without a securing plate. This plate is added to insure that no loss or disassembly occurs and when said plate is brought into position the screw is tightened to the desired degree.

Terms such as "left", "right", "up", "down", "bottom", "top", "front", "back", "in", "out" and the like are applicable to the embodiments shown and described in conjunction with the drawing. These terms are merely for the purposes of description and do not necessarily apply to the position in which the box joint for a plier-type tool and the securing plate may be constructed or used.

While particular embodiments of the box joints and securing plates have been shown and described it is to be understood the invention is not limited thereto and protection is sought to the broadest extent the prior art allows.

What is claimed is:

1. A box joint for a plier-type tool in which the movable member portions are pivotally retained and manipulated, this tool having handle and jaw portions integrally connected, said improved box joint enabling assembly and disassembly without distorting the box joint portion and requiring reshaping of the distorted portion by and with heat and pressure, the box joint including:

(a) first member portion extending between a handle and jaw portion and providing a midportion of the box joint, this midportion having a length greater than its width and finished on its extending and transverse surfaces with said midportion providing substantially one-half the thickness of the box joint and with the finished surfaces substantially parallel to each other;

(b) a second member portion extending between a handle and jaw portion and providing two outer wall retentions of the box joint, the interior surfaces finished to snugly mate with and retain the midportion of the other member portion;

(c) a transverse opening formed in one of the outer wall portions of said second member forming the box joint, this opening having stepped shoulder end configurations, this opening having the narrower portion at the inner edges thereof and with this inner narrower portion opening greater than the width of the midportion of the first member, said narrower portion providing retention portions for the midportion of the first member after insertion and rotation of the first and second members toward and to an in-use and closed condition;

(d) a retaining plate sized so as to enter and be seated in said transverse opening of the second member and with ends formed on said plate providing stepped shoulders sized to be a sliding fit in said opening, the inner surface of said plate finished so as to provide a contiguous mating surface with the facing misportion of the first member when said plate is mounted in said opening, and (e) a retaining cap screw having a head portion that engages the retaining plate to prevent unwanted outward movement, a shank of the screw passing through a hole in the plate and midportion and a threaded end of said screw entering into a threaded aperture in the outer wall of the second member, the screw adjusted to provide the desired tightening of the box joint.

2. A box joint for a plier-type tool as in claim 1 in which the ends of the transverse opening in the second member are made with outwardly facing angled surfaces with the greater thickness of said end portions being at the opening, and the retaining plate is formed with compatibly shaped surfaces so configured that the mounted plate first engages and retains the midportion of the box joint with a minimum of adjusting space in said end portions.

3. A box joint for a plier-type tool as in claim 1 in which the ends of the transverse opening in the second member are made with end surfaces substantially parallel to the inner supporting finished surface of the second member and the retaining plate is formed with compatibly shaped surfaces so configured that the mounted plate first engages and retains the midportion of the box joint with a minimum of adjusting space in said end portions.

4. A box joint for a plier-type tool as in claim 1 in which the shank of the shoulder screw is made slightly shorter than the thickness of the midportion of said first member and that portion of the retaining plate under the head so that the screw may be tightened to provide adjustment for wear.

5. A box joint for a plier-type tool as in claim 1 in which all interior surfaces of the box joint including the midportion, the interior surfaces of the second member, and the interior surface of the retaining plate are made with very smooth surfaces such as are produced by grinding, broaching and/or lapping.

6. A box joint for a plier-type tool as in claim 1 in which the inwardly extending end portions of the second member adjacent the transverse opening are about one-half the thickness of the midportion of the first member.

7. A box joint for a plier-type tool as in claim 1 in which the retaining plate is formed with a counterbore for the retention of the head of the shoulder screw.

8. A box joint for a plier-type tool as in claim 1 in which the retaining plate is formed with a counterbore in the outwardly facing surface, this counterbore disposed to receive the outer diameter of the head of the cap screw.

9. A box joint for a plier-type tool as in claim 1 in which the handles are formed with a curved shape and the jaw ends have hardened portions adapted to shape and bend wire.

10. A box joint for a plier-type tool as in claim 1 in which the head of the cap scrw is formed with a socket head for a wrench.

11. A box joint for a plier-type tool as in claim 1 in which the head of the cap screw is formed with a screw driver slot.

* * * * *